US010682557B2

(12) United States Patent
Ambrose

(10) Patent No.: US 10,682,557 B2
(45) Date of Patent: Jun. 16, 2020

(54) GOLF PUTTER GRIP AND GOLF PUTTER INCORPORATING SAME

(71) Applicant: Lateral Line, LLC., Jefferson, OH (US)

(72) Inventor: John Ambrose, Jefferson, OH (US)

( * ) Notice: Subject to any disclaimer, the term of this patent is extended or adjusted under 35 U.S.C. 154(b) by 57 days.

(21) Appl. No.: 15/278,133

(22) Filed: Sep. 28, 2016

(65) Prior Publication Data

US 2017/0087430 A1 Mar. 30, 2017

Related U.S. Application Data

(60) Provisional application No. 62/234,129, filed on Sep. 29, 2015.

(51) Int. Cl.

| | |
|---|---|
| ***A63B 53/14*** | (2015.01) |
| ***A63B 60/08*** | (2015.01) |
| ***A63B 53/00*** | (2015.01) |
| ***A63B 60/14*** | (2015.01) |
| ***A63B 60/10*** | (2015.01) |
| ***A63B 71/06*** | (2006.01) |

(52) U.S. Cl.

CPC ..... *A63B 53/14* (2013.01); *A63B 53/007* (2013.01); *A63B 60/08* (2015.10); *A63B 60/14* (2015.10); *A63B 60/10* (2015.10); *A63B 2071/0694* (2013.01)

(58) Field of Classification Search

CPC ..... A63B 53/14

See application file for complete search history.

(56) References Cited

U.S. PATENT DOCUMENTS

| | | | | |
|---|---|---|---|---|
| 3,219,348 | A | 11/1965 | Dishner | |
| 4,067,573 | A | 1/1978 | Key, Jr. | |
| D280,119 | S | 8/1985 | McRae | |
| 5,110,653 | A * | 5/1992 | Landi | A63B 49/08 428/116 |
| D355,011 | S | 1/1995 | Subnick | |
| D355,463 | S | 2/1995 | Markward et al. | |
| D377,070 | S | 12/1996 | Gurrola | |
| D379,837 | S | 6/1997 | Chou et al. | |
| D391,330 | S | 2/1998 | Solheim et al. | |
| D392,357 | S | 3/1998 | Chou et al. | |
| D399,901 | S | 10/1998 | Beyer | |
| D408,461 | S | 4/1999 | Lamkin | |
| D431,851 | S | 10/2000 | Anderson | |

(Continued)

*Primary Examiner* — Michael D Dennis

(74) *Attorney, Agent, or Firm* — Blynn L. Shideler; Krisanne Shideler; BLK Law Group

(57) ABSTRACT

A golf putter grip comprises a main body extending at least 7 inches, more preferably about 14 inches, from a top to a bottom end, a flat front surface has a width less than 1.75 inches, generally about 1.60 to 1.65 inches, and a shaft receiving bore within the grip extending substantially to the top end, wherein the bore is centered between lateral sides of the grip and the bore is angled relative to the main body's longitudinal centerline extending away from the front surface in the direction toward the bottom end. A putter incorporating this grip yields a better tempo and motion, will neutralize the dominant hand and forearm throughout the stroke, will stabilizes the hands and allow for a quieter grip to aid in reducing the yips, and will reduce the wrist angle at address to relieve arm tension.

20 Claims, 4 Drawing Sheets

(56) References Cited

U.S. PATENT DOCUMENTS

| | | | | |
|---|---|---|---|---|
| 6,152,832 | A * | 11/2000 | Chandler, III | A63B 53/14 473/292 |
| D488,202 | S | 4/2004 | Jaffe | |
| 6,783,463 | B2 | 8/2004 | Zichmanis | |
| 6,786,835 | B1 * | 9/2004 | Carter | A63B 53/007 473/300 |
| 6,875,125 | B1 | 4/2005 | Federowicz | |
| 6,902,492 | B1 | 6/2005 | Strand | |
| D512,758 | S | 12/2005 | Tuerschmann et al. | |
| D515,649 | S | 2/2006 | Zichmanis | |
| D524,390 | S | 7/2006 | Tuerschmann | |
| D545,388 | S | 6/2007 | Chen | |
| D548,808 | S | 8/2007 | Chen | |
| D590,903 | S | 4/2009 | Dingman et al. | |
| D598,512 | S | 8/2009 | Dingman et al. | |
| D652,099 | S | 1/2012 | Hohman et al. | |
| D652,100 | S | 1/2012 | Hohman et al. | |
| 8,858,356 | B2 | 10/2014 | Chu et al. | |
| D717,894 | S | 11/2014 | Dingman | |
| 8,932,146 | B2 | 1/2015 | Chu et al. | |
| 9,072,952 | B2 | 7/2015 | Chu et al. | |
| D738,973 | S | 9/2015 | Dingman | |
| 2003/0181254 | A1 | 9/2003 | Zichmanis | |
| 2004/0259660 | A1 | 12/2004 | Zichmanis | |
| 2006/0068929 | A1 * | 3/2006 | Goldfader | A63B 69/3685 473/294 |
| 2007/0082750 | A1 * | 4/2007 | Rose | A63B 53/14 473/300 |
| 2011/0165957 | A1 * | 7/2011 | Lu | A63B 53/14 473/298 |
| 2013/0203514 | A1 | 8/2013 | Chu et al. | |
| 2013/0225313 | A1 | 8/2013 | Garsen | |
| 2014/0200097 | A1 | 7/2014 | Chu et al. | |
| 2014/0213385 | A1 | 7/2014 | Chu et al. | |
| 2015/0005087 | A1 | 1/2015 | Nathan | |
| 2015/0196813 | A1 | 7/2015 | Chu et al. | |

* cited by examiner

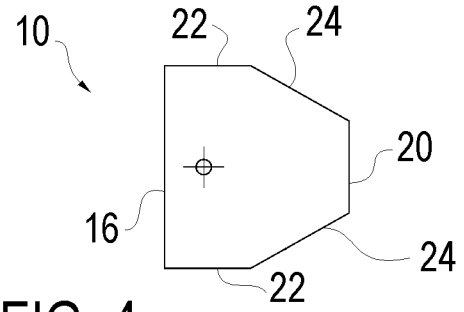
FIG. 4
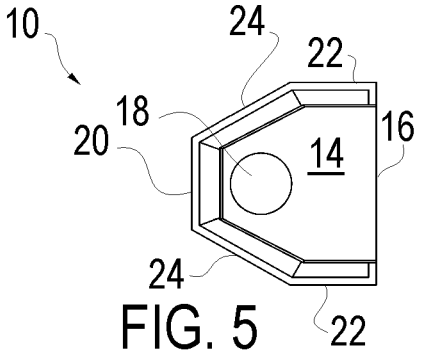
FIG. 5
FIG. 10
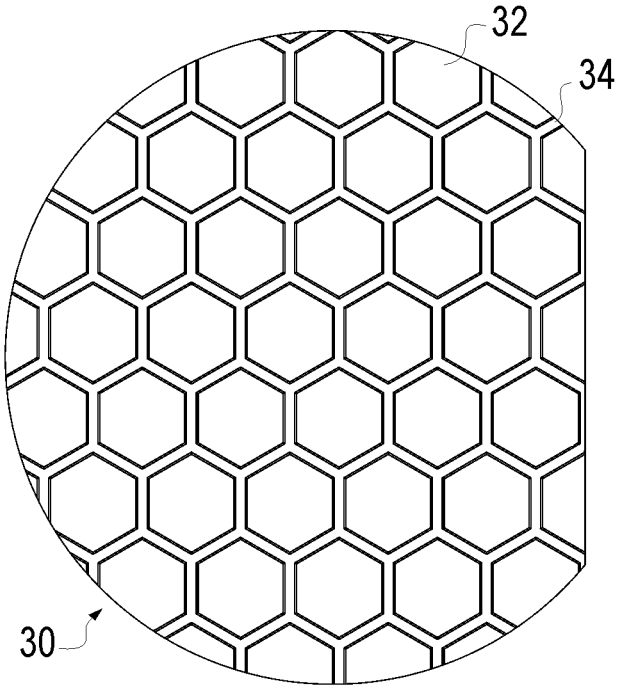

GOLF PUTTER GRIP AND GOLF PUTTER INCORPORATING SAME

RELATED APPLICATIONS

This application claims priority to U.S. provisional patent application Ser. No. 62/234,129 filed Sep. 29, 2015, entitled "Golf Putter Grip and Golf Putter Incorporating Same" invented by John Ambrose.

BACKGROUND OF THE INVENTION

Field of the Invention

The present invention relates to a golf putter grip and associated putter configured to improve putting mechanics or motions.

Background Information

The game of golf has a long rich history and enjoys exceptional worldwide popularity, with over 35,000 courses worldwide. In 2005, *Golf Digest* calculated that the countries with most golf courses per capita, in order, were: Scotland, New Zealand, Australia, Ireland, Canada, Wales, United States, Sweden, and England.

Putting, the act of hitting the golf ball on the putting green generally with a putter, represents one of the largest aspects of the game of golf. A putter is technically defines as a golf club with a loft not exceeding ten degrees designed primarily for use on the putting green. Considering it is often said that the average golfer takes about ⅔rds of his total shots from less than 100 feet from the hole, then it becomes evident that a golfer cannot score well without putting at least adequately. The "art" of putting however is no more easily perfected than the other parts of a golfer's game. For perspective it is often suggested that a golfer is a bad putter when they exceed 36 putts per round, and that better golfers actually use about 32 putts per round.

Golf theory teaches that the putting stroke should be executed in generally pendulum-like fashion, with the goal of allowing the golfer to putt the ball more accurately with regard to both distance and direction (or speed and line).

The grip of a golf club generally consists of material added to the shaft to enable the player to obtain a firm hold of the club. The grip is generally fixed to the shaft. The grip of the putter represents the interaction between the golfer and the putter and many attempts have been proposed to design the putter grip to improve putting mechanics. The following are some representative examples that indicate some aspect of the scope and content of the putter grip prior art.

U.S. Pat. Pub. Nos. 2015-0196813, 2014-0213385 (now U.S. Pat. No. 9,072,952), 2014-0200097 (now U.S. Pat. No. 8,932,146), and 2013-0203514, (now U.S. Pat. No. 8,858,356), disclose golf putter grips including a non-circular symmetrical cross-section with a flat front. The non-circular cross-section and the flat front area respectively have a width sufficient to have two hands cupped together at the same height and two thumbs placed side by side on the flat front area to hold the putter grip comfortably with minimal wrist breaking-down.

U.S. Pat. Pub. No. 2015-0005087 discloses a golf putter grip with a substantially flat front portion and a substantially curved rear portion and a pattern disposed on the golf putter grip that allegedly aids the golfer in perfecting the golf putter swing.

U.S. Pat. Pub. No. 2013-0225313 discloses a golf putter grip having a main grip area having a forward facing surface which is "V" shaped with the vertex of the "V" pointing away from the golfer. The rear-facing surface of the main grip area having a "C" shaped cross section which is convex from the viewpoint of the rear of the grip.

U.S. Pat. Pub. Nos. 2004-0259660 and 2003-0181254 disclose grips for a golf putter having a thumb-receiving surface and finger-receiving surfaces on opposite lateral sides thereof and normal to the thumb-receiving surface. The grip defines a pointed portion including the second end and the finger-receiving surfaces which is adapted to be gripped by a golfer with the thumbs in side-by-side relation upon the thumb-receiving surface pointing towards a club head of the putter, the index fingers lie upon the finger-receiving surfaces and against the thumbs, the tips of the middle fingers touch and lie against the index fingers and a rear surface of the handle, and the ring and small fingers of the golfer's hands are intertwined.

U.S. Pat. No. 6,902,492 discloses a putter grip including a hollow tapered body having a modified rectangular cross section.

U.S. Pat. No. 6,875,125 discloses a putter grip with two grooves each of the two grooves disposed between one of the side members and the center member of the grip.

U.S. Pat. No. 6,783,463 discloses a putter grip which has, on its front, a thumb-receiving surface, and, on respective sides, adjacent the second end, finger-receiving surfaces, and can be held in a grip wherein the thumbs point towards the head and lie parallel upon the thumb-receiving surface; the middle finger tips touch; in each hand, the forefinger lies against the thumb and against a respective finger-receiving surface and the middle finger lies against the forefinger and against a respective finger-receiving surface; and the ring and small fingers are intertwined.

U.S. Pat. No. 3,219,348, as well as U.S. Pat. No. 4,067,573 each discloses putter grips constructed in substantially bulbous form, which is contrary to the present Rules of Golf as promulgated by the United States Golf Association and other golf regulating bodies.

See also the "ornamental" golf putter grip designs reflected in U.S. Design Pat. Nos. D738,973, D717,894, D652,100, D652,099, D598,512, D598,512, D590,903, D548,808, D545,388, D524,390, D515,649, D512,758, D488,202, D431,851, D408,461, D399,901, D392,357, D391,330, D379,837, D377,070, D355,463, D355,011, and D280,119.

The above identified patents and published applications are incorporated herein by reference and give a detailed background of the prior art putter grip designs. None of these prior art solutions represents an adequate solution for all golfers and there remains a need for a golf putter grip and associated putter configured to improve putting mechanics or motions.

SUMMARY OF THE INVENTION

The present invention addresses the deficiencies of the prior art and provides a golf putter grip comprising a main body extending at least 7 inches (177.8 mm) in length, generally at least 10 inches and more preferably about 14 inches, from a top end to a bottom end, a flat front surface extending substantially from the top end to the bottom end and having a width less than 1.75 inches (44.45 mm), generally about 1.65 inches, and a shaft receiving bore within the golf putter grip extending from the bottom end substantially to the top end, wherein the shaft receiving bore is centered between lateral sides of the golf putter grip between the top end and the bottom end and wherein the shaft receiving bore is angled relative to a longitudinal center line of the main body to extend away from the flat front surface in the direction along the main body from the top end to the bottom end. A putter incorporating this grip yields a better tempo and motion and will neutralize the dominant hand and forearm throughout the stroke, will stabilizes the hands and allow for a quieter grip to aid in reducing the yips and will reduce the wrist angle at address to relieve arm tension.

These and other advantages are described in the brief description of the preferred embodiments in which like reference numeral represent like elements throughout.

BRIEF DESCRIPTION OF THE FIGURES

FIG. 4 is a top end view of the golf putter grip of FIG. 1;

FIG. 5 is a bottom end view of the golf putter grip of FIG. 1;

FIG. 10 is an enlarged front elevation view of the unwrapped textured cover of FIG. 9;

DESCRIPTION OF THE PREFERRED EMBODIMENTS

As noted above a putter is technically defined as a golf club with a loft not exceeding ten degrees designed primarily for use on the putting green. There is, however, nothing in the rules that prevents a player from using a putter off of the green and golfers frequently employ their putters from the green's fringe when there are no obstacles between the golf ball and the green. There is also nothing in the rules of golf preventing a player from putting on the green with a club other than a putter, but the game of golf is hard enough without adding unnecessary complexity. Regardless the present invention is related to a golf putter grip 10 and associated putter configured to improve putting mechanics or motions The grip 10 of the invention is principally for the purpose of assisting the player in obtaining a firm hold and improving the putting mechanics. The grip 10 is fixed to the shaft of the putter via a friction fit and or with adhesives, and is generally straight and plain in form as shown, and is configured to extend to the end of the shaft of the putter.

Figure 1:
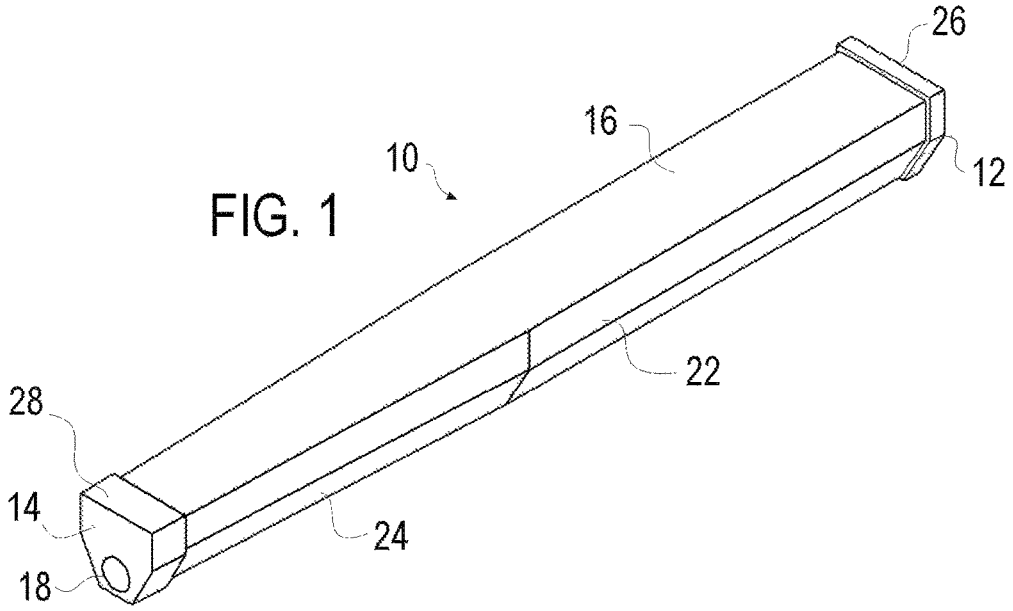
FIG. 1 is a bottom-front perspective view of golf putter grip, without textured cover, according to one embodiment of the present invention.
Figure 2:
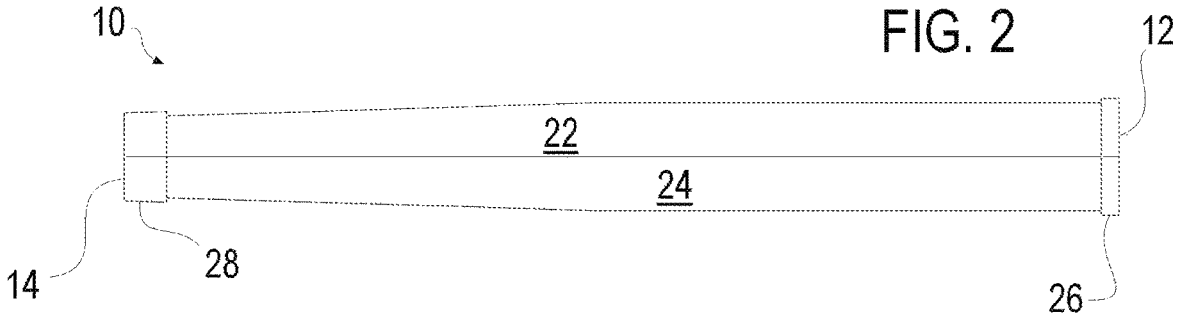
FIG. 2 is a side elevation view of the golf putter grip of FIG. 1.
Figure 3:
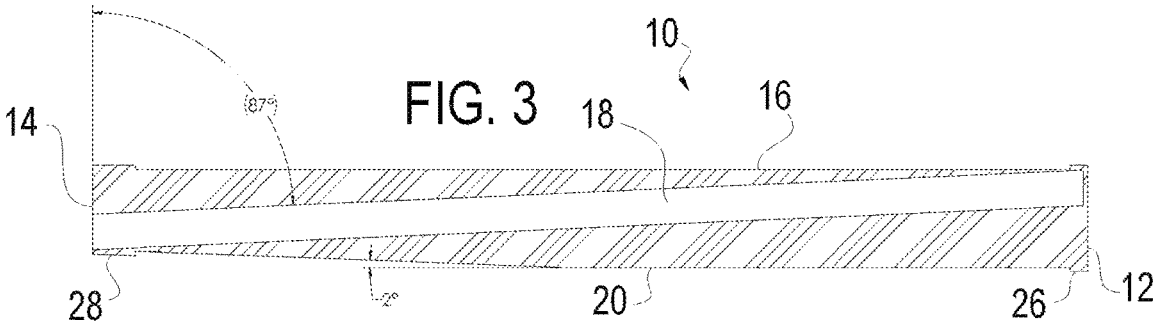
FIG. 3 is a side sectional view of the golf putter grip of FIG. 1.
Figure 6:
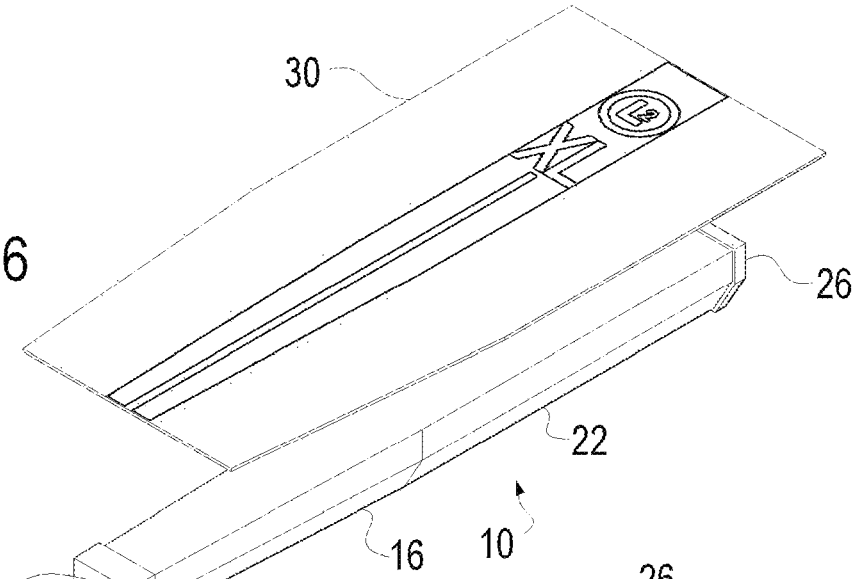
FIG. 6 is a partially exploded bottom-front perspective view of the golf putter grip of FIG. 1 with unwrapped textured cover.
Figure 7:
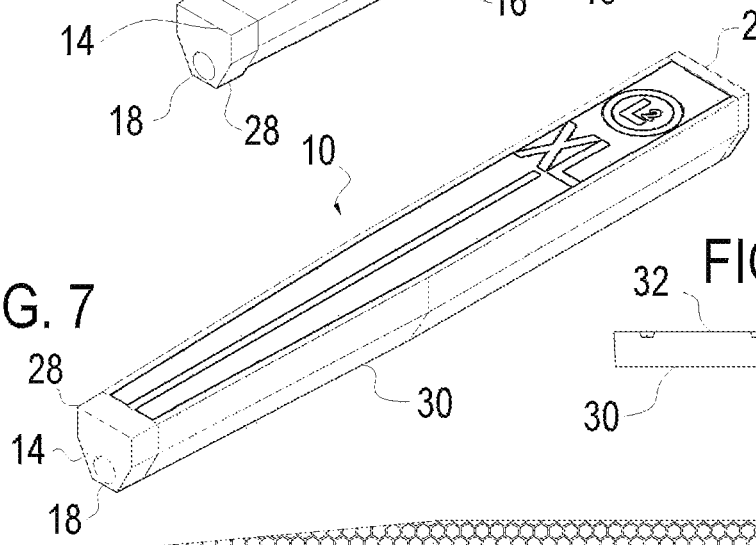
FIG. 7 is a bottom-front perspective view of the golf putter grip of FIG. 1 with textured cover.
Figure 12:
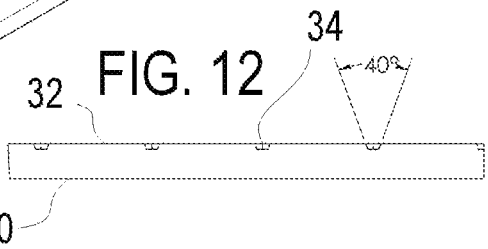
FIG. 12 is an enlarged side sectional view of the unwrapped textured cover of FIG. 9.
Figure 9:
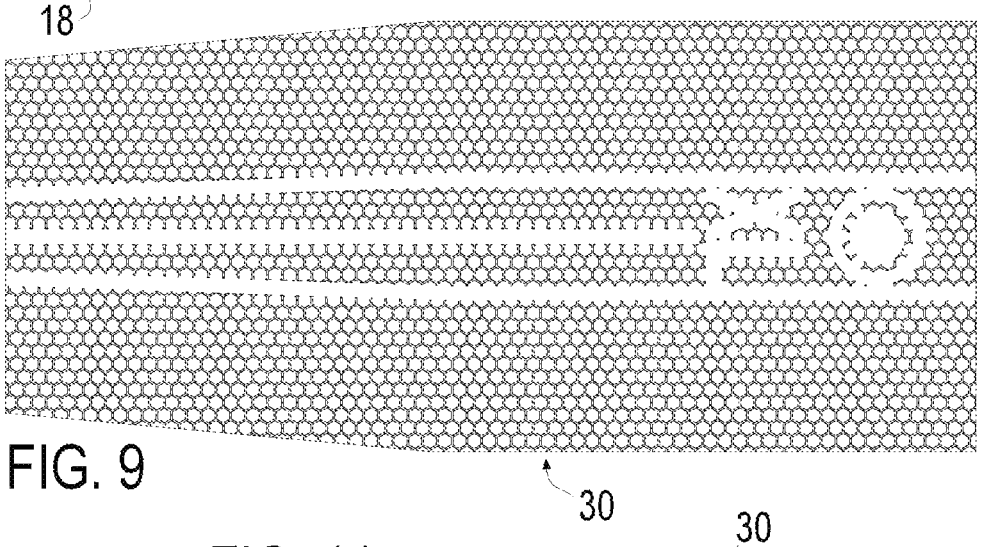
FIG. 9 is a front elevation view of the unwrapped textured cover of FIG. 6 highlighting the texturing.
Figure 11:
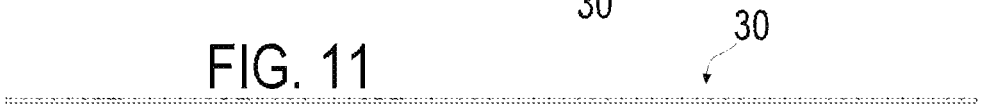
FIG. 11 is a side elevation view of the unwrapped textured cover of FIG. 9.
Figure 8:
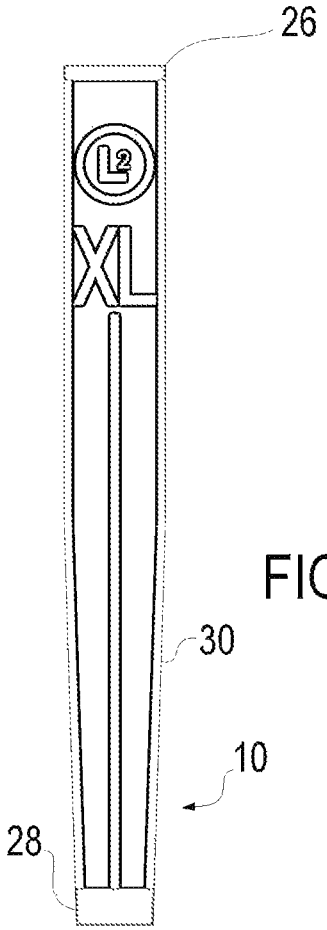
FIG. 8 is a front elevation view of the golf putter grip of FIG. 7.

The grip 10 of the invention preferably is not molded for any part of the hands, in compliance with USGA and other governing body rules. The grip 10 is preferably at least seven (7) inches (177.8 mm) in length and more preferably at least 10 inches (254 mm) in length. The grip 10 of the illustrated embodiment of the present invention is 14 inches long, measured along the longitudinal length of the grip 10 as shown in FIGS. 2 and 3.

The putter grip 10 according to the present invention is generally non-circular cross-section as shown, and preferably is free of any concavity, is symmetrical and is configured to remain "generally similar" through-out the length of the grip 10 as such term is known in the art (defined in the USGA rules). In order to accommodate the popular (and somewhat traditional) "pistol-type" putter grips with an alteration of the present invention as shown, the phrase "generally similar" is interpreted herein to mean: (i) that the top end 12 (also butt end) of the grip 10 should not involve a sharp change in slope or dramatic flare on the underside; and (ii) that the flat front 16 must extend to within 1 inch (25.4 mm) of the top end 12 and the bottom end 14. Thus the grip 10 of the present invention may be formed as a pistol type putter grip and still be "generally similar" in cross section throughout the length of the grip 10.

Further the cross-sectional dimensions across the grip 10 measured in any direction preferably does not exceed 1.75 inches (44.45 mm) as conventionally measured by the USGA. The golf putter grip 10 according to the invention has a total weight generally between 100 and 150 grams and more preferably about 95-140 grams, and one embodiment about 120 grams (+/−5 grams).

A summary of the grip 10 of the invention is helpful for a detailed understanding of the present invention. A golf putter grip 10 in accordance with the invention comprises a main body shown alone in FIGS. 1-5 extending the length of the grip 10, namely at least 7 inches (177.8 mm) in length from the top end 12 to the bottom end 14. More preferably the main body extends at least 10 inches (254 mm) in length, and most preferably the grip extends about 14 inches (+/−10%). The main body may be formed of any conventional material, such as being injection molded from a hard thermosetting plastic.

The main body of the grip 10 includes a flat front surface 16 extending substantially, within at least one inch (25.4 mm), from the top end 12 to the bottom end 14 and having a width less than 1.75 inches (44.45 mm), preferably in one or a first embodiment having a width of about 1.65 inches (+/−0.05 inches) and in a second alternative embodiment having a width of about 1.60 inches (+/−0.05 inches), wherein the width of this surface is perpendicular to the longitudinal length. The two embodiments of the present invention (first and second herein) have the same overall shape, just slightly altered dimensions and thus the two specific embodiments will be described in connection with the same figures and only differ when it is expressly mentioned. The flat front surface 16 of the main body extends from a top end band 26, which is 0.25 inches (6.4 mm) in thickness measured along the longitudinal axis of the grip 10, and a bottom end band 28 which is 0.60 inches (15.2 mm) in thickness, on the main body. The top end band 26 and the bottom end band 28 follow and define the circumferential shape of the putter grip 10, with the remaining portions of the main body between the top end band 26 and the bottom end band 28 being recessed to accommodate the cover 30 described below.

The main body of grip 10 includes a flat rear surface 20 extending substantially from the top end 12 to the bottom end 14, namely from the top end band 26 to the bottom end band 28. The flat rear surface 20 having a width less than the width of the flat front surface 16, namely about 0.750 inches (19.1 mm) in the first embodiment and 0.60" in a second embodiment. The width of the rear surface 20 is measured perpendicular to the longitudinal axis of the grip 20 and is selected to accommodate the putter shaft receiving bore 18 and to fit within the desired maximum profile of the circumference of the grip 10. The rear surface 20 is parallel to the front surface 16 and centered relative to the front surface 16 and the sides of the grip 10.

The golf putter grip 10 according to invention includes a pair of side surfaces on the main body of the grip 10 each extending substantially from the top end 12 to the bottom end 14, specifically from the top end band 26 to the bottom end band 28. Each side surface extends from the flat front surface 16 to the flat rear surface 20 and has a width or depth of about 1.50" in the first embodiment and about 1.25" in the second embodiment of the invention. Each side surface includes a planer front side portion 22 adjacent the flat front surface 16 and a planer rear side portion 24 adjacent the flat rear surface 20. Each planer front side portion 22 is substantially perpendicular to the flat front surface 16 and each planar rear side portion 24 is angled relative to the planar front side portion 16 and the rear surface 20. Each planar rear side portion 24 may have a width of about 0.80" measured in the plane it extends. Each planer front side portion 22 has a width of about 0.70" in the first embodiment and about 0.50" in the second embodiment of the invention.

The grip 10 of the invention includes a shaft receiving bore 18 within the golf putter grip 10 extending from the bottom end 14 substantially to the top end 12 (within 2 mm of the top end 12). The shaft receiving bore 18 is configured to receive the shaft of a putter therein and be secured via adhesive and/or friction fit. The bore 18 will be dimensioned to match the shaft, generally 0.5 inches (12.7 mm) in diameter throughout for a first common shaft and about 0.58" for a second common shaft diameter. The bore 18 is centered between lateral sides (22, 24) of the golf putter grip 10 between the top end 12 and the bottom end 14 and the shaft receiving bore 18 is angled relative to a longitudinal center line of the main body to extend away from the flat front surface 16 in the direction along the main body from the top end 12 to the bottom end 14, as shown best in FIG. 3. The shaft receiving bore is within 2 mm of the flat front surface 16 adjacent the top end of the grip 10 and within 2 mm of rear surface adjacent the bottom end of the grip. The golf putter grip 10 according to invention provides that the shaft receiving bore 18 is angled between 2 and 5 degrees relative to the longitudinal axis along the grip 10, generally about 3 degrees (+/−0.5 degrees) relative to the longitudinal axis along the grip.

As shown in FIG. 2 golf putter grip according to invention provides wherein the main body includes an inwardly tapered portion extending in a direction toward the bottom end 14 beginning at a location a little over midway from the top end 12, namely 7.375 inches from the top end 12. The inward taper is about 2 degrees (+/−0.5 degrees).

The golf putter grip 10 according to the invention further includes a textured cover 30 surrounding the main body, best shown in FIGS. 6-12. The textured cover 30 is positioned between the top end band 26 and the bottom end band 28 and can be secured to the main body via adhesives. The textured cover 30 includes honeycomb gripping elements 32 thereon which are separated by channels 34 (with sides beveled to form about a 40 degree angle as shown) as best shown in FIGS. 9-12. The textured cover 30 is formed of high friction/grip enhancing material, such as a rubber or rubberized plastic. The surfaces of cover 30 may include printing indicia as desired.

Figure 13:
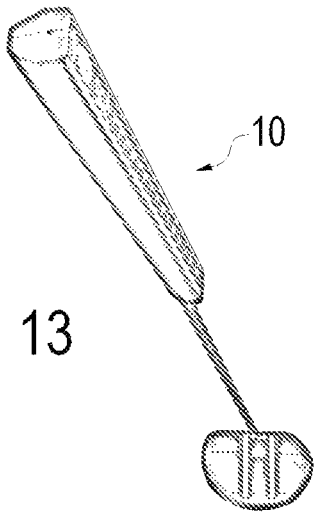
FIG. 13 is a perspective view of a golf putter incorporating the grip 10 of FIG. 7.

FIG. 13 illustrates a golf putter including the grip 10 of the present invention. The golf putter may be formed with any shaft and head, preferably only limited to the restrictions on putter shafts and heads in the rules of golf (see USGA rules for clubs).

The grip 10 of the present invention as shown and described has a unique multi-sided shape which allows hands and fingers to be placed in a stabilizing position. The grip 10's weight of 120 grams allows the head weight feel to increase for a better tempo feel for the user.

The flat front 16 of the grip 10 is 1.60" or 1.65" in the two described embodiments which enables golfer to apply an "opposing palm" position which neutralizes the dominant hand and forearm throughout the putting stroke. The large diameter of the grip 10 stabilizes the hands and allow for a quieter grip which aids in reducing the yips while promoting a "dead hands" arm and shoulder stroke for better tempo and a pendulum motion. Further, the angled shaft places more of the grip 10 under the shaft at the top which creates a feel of more lie angle, and reduces the wrist angle at address, which relieves arm tension for a more relaxed feel. All of these features combine to yield a golf putter grip 10, and associated golf putter, to improve putting mechanics and motion for improved accuracy in both speed and direction of putts.

The illustrated embodiment is only one of many embodiments of the present invention, however it is appreciated that some of the parameters of the grip 10 may be further optimized to maximize the results. For example in the illustrated embodiment the material in the top rear portion of the grip 10 may be removed to maintain the largest diagonal direction within 1.75" if needed. Specifically, in effect the flat rear surface 20 may be figuratively ground down to achieve this desired dimensional restriction while maintaining all the other characteristics of the grip. The key operational aspects for optimizing the grip according to the aspects of the present invention are i) maintaining the fore-aft angled shaft receiving bore 18 as shown, ii) a flat front surface 16 width sufficient to accommodate side by side thumbs (e.g. about 1.60" to 1.65"), iii) maintaining Maximum angle/diameter close to 1.75" to maintain the desired putter head feel, but not exceeding 1.75" in any direction, and iv) maintaining a minimum grip 10 length of 10". The general 6 sided cross sectional shape as shown which is symmetrical about the centerline is preferred, but many variables exist within this framework allowing an unlimited number of specific grips 10 within these criteria by changing the angles/widths of the surfaces along the grip 10

The preferred embodiments described above are illustrative of the present invention and not restrictive hereof. It will be obvious that various changes may be made to the present invention without departing from the spirit and scope of the invention. The precise scope of the present invention is defined by the appended claims and equivalents thereto.

What is claimed is:

1. A golf putter grip comprising a main body extending at least 7 inches (177.8 mm) in length from a top end to a bottom end, a flat front surface extending substantially from the top end to the bottom end and having a width less than 1.75 inches (44.45 mm) and configured to accommodate side by side thumbs with an opposing palm position grip of the golfer, and a shaft receiving bore within the golf putter grip extending from the bottom end substantially to the top end, wherein the shaft receiving bore is centered between lateral sides of the golf putter grip between the top end and the bottom end and wherein the shaft receiving bore is angled relative to a longitudinal center line of the main body to extend away from the flat front surface in the direction along the main body from the top end to the bottom end.

2. The golf putter grip according to claim 1 wherein the flat front surface extends substantially from the top end to the bottom end has a width of about 1.65 inches adjacent the top end.

3. The golf putter grip according to claim 1 wherein the main body extends at least 10 inches (254 mm) in length in length from a top end to a bottom end.

4. The golf putter grip according to claim 1 wherein the main body extends about 14 inches in length in length from a top end to a bottom end.

5. The golf putter grip according to claim 1 wherein the cross-sectional dimensions across the grip measured in any direction does not exceed 1.75 inches (44.45 mm).

6. The golf putter grip according to claim 1 wherein the weight of the grip is between 100 and 140 grams.

7. The golf putter grip according to claim 1 wherein the weight of the grip is about 120 grams.

8. The golf putter grip according to claim 1 wherein the shaft receiving bore is within 2 mm of the flat front surface adjacent the top end of the grip.

9. The golf putter grip according to claim 1 wherein the shaft receiving bore is within 2 mm of rear surface adjacent the bottom end of the grip.

10. The golf putter grip according to claim 1 wherein the shaft receiving bore is angled between 2 and 5 degrees relative to the longitudinal axis along the grip.

11. The golf putter grip according to claim 1 wherein the shaft receiving bore is angled about 3 degrees relative to the longitudinal axis along the grip.

12. The golf putter grip according to claim 1 further including a textured cover surrounding the main body.

13. The golf putter grip according to claim 12, wherein the textured cover includes honeycomb gripping elements thereon.

14. The golf putter grip according to claim 12 further including a top end band and a bottom end band on the main body and wherein the textured cover is positioned between the top end band and the bottom end band.

15. The golf putter grip according to claim 1, wherein the main body includes a flat rear surface extending substantially from the top end to the bottom end and having a width less than the width of the flat front surface.

16. The golf putter grip according to claim 15, wherein the main body includes a pair of side surfaces each extending substantially from the top end to the bottom end and each extending substantially from the flat front surface to the flat rear surface.

17. The golf putter grip according to claim 16, wherein each side surface includes a planer front side portion adjacent the flat front surface and a planer rear side portion adjacent the flat rear surface wherein the planar rear side portion is angled relative to the planar front side portion.

18. The golf putter grip according to claim 17, wherein each planer front side portion is substantially perpendicular to the flat front surface.

19. The golf putter grip according to claim 1, wherein the main body includes an inwardly tapered portion extending in a direction toward the bottom end.

20. A golf putter including the grip of claim 1 wherein a face of the putter head is substantially perpendicular to the flat front surface of the grip.

* * * * *